US010439275B2

(12) United States Patent
MacNeille et al.

(10) Patent No.: US 10,439,275 B2
(45) Date of Patent: Oct. 8, 2019

(54) MULTIPLE ORIENTATION ANTENNA FOR VEHICLE COMMUNICATION

(71) Applicant: Ford Global Technologies, LLC, Dearborn, MI (US)

(72) Inventors: Perry Robinson MacNeille, Lathrup Village, MI (US); Allen R. Murray, Lake Orion, MI (US); Oliver Lei, Windsor (CA)

(73) Assignee: Ford Global Technologies, LLC, Dearborn, MI (US)

( * ) Notice: Subject to any disclaimer, the term of this patent is extended or adjusted under 35 U.S.C. 154(b) by 109 days.

(21) Appl. No.: 15/191,824

(22) Filed: Jun. 24, 2016

(65) Prior Publication Data

US 2017/0373384 A1 Dec. 28, 2017

(51) Int. Cl.

| | |
|---|---|
| ***H01Q 1/32*** | (2006.01) |
| ***H01Q 1/42*** | (2006.01) |
| ***H01Q 3/02*** | (2006.01) |
| ***H01Q 13/10*** | (2006.01) |
| ***H01Q 3/04*** | (2006.01) |

(52) U.S. Cl.

CPC ..... *H01Q 1/3275* (2013.01); *H01Q 1/428* (2013.01); *H01Q 3/02* (2013.01); *H01Q 3/04* (2013.01); *H01Q 13/10* (2013.01); *H01Q 13/106* (2013.01)

(58) Field of Classification Search

CPC ..... H01Q 1/32; H01Q 1/42; H01Q 13/106; H01Q 3/02

USPC ..... 343/713

See application file for complete search history.

(56) References Cited

U.S. PATENT DOCUMENTS

| | | | | |
|---|---|---|---|---|
| 2,480,181 A | | 8/1949 | Breen et al. | |
| 2,601,610 A | | 6/1952 | Hatch et al. | |
| 2,635,188 A | * | 4/1953 | Riblet | H01Q 21/0062 333/242 |
| 2,648,003 A | | 8/1953 | Lan | |
| 2,809,370 A | | 10/1957 | Pinnell | |

(Continued)

FOREIGN PATENT DOCUMENTS

| | | |
|---|---|---|
| EP | 2466549 A1 | 6/2012 |
| GB | 2547552 A | 8/1917 |

(Continued)

OTHER PUBLICATIONS

Search Report dated Nov. 27, 2017 for Great Britain Patent Application No. GB 1709999.5 (5 Pages).

(Continued)

*Primary Examiner* — Huedung X Mancuso

(74) *Attorney, Agent, or Firm* — Frank Lollo; Neal, Gerber & Eisenberg LLP; James P. Muraff

(57) ABSTRACT

Systems and apparatus are disclosed for a multiple orientation antenna for vehicle communications. An example multiple orientation antenna includes a housing and a first and second set of shutters embedded into the housing. The example multiple orientation antenna also includes a waveguide disposed within the housing defining a first and second set of slot antennas. The slot antennas of the first set of slot antennas are oriented to facilitate horizontal communication. The slot antennas of the second set of slot antennas are oriented to facilitate vertical communication. Additionally, the example multiple orientation antenna includes a rotation motor to rotate the housing.

12 Claims, 5 Drawing Sheets

(56) References Cited

U.S. PATENT DOCUMENTS 3,106,713 A * 10/1963 Murata ..... H01Q 13/203 333/237
3,377,596 A 4/1968 Spitz
3,761,937 A * 9/1973 Tricoles ..... H01Q 1/425 343/770
4,825,219 A * 4/1989 Ajioka ..... H01Q 21/0062 343/768
7,088,295 B2 8/2006 Komatsu et al.
7,388,553 B2 6/2008 Yuanzhu
8,633,865 B2 * 1/2014 Miyagawa ..... H01Q 1/42 343/705
8,836,592 B2 9/2014 Paulus et al.
8,970,428 B2 * 3/2015 Yano ..... H01Q 1/42 342/175
9,711,870 B2 * 7/2017 Izadian ..... H01Q 21/005
2002/0050946 A1 5/2002 Chang et al.
2003/0043083 A1 3/2003 Huang
2003/0095074 A1 * 5/2003 Scorer ..... H01Q 13/0233 343/772
2005/0180742 A1 * 8/2005 Jeong ..... G03B 9/08 396/451
2005/0200545 A1 9/2005 Bancroft
2005/0219134 A1 * 10/2005 Sergey ..... H01Q 3/22 343/770
2005/0238347 A1 * 10/2005 Oh ..... G03B 9/06 396/449
2008/0117114 A1 * 5/2008 Haziza ..... H01Q 13/00 343/786
2009/0277630 A1 * 11/2009 McDaniel ..... E21B 43/26 166/250.1
2010/0321265 A1 * 12/2010 Yamaguchi ..... H01Q 13/22 343/771
2010/0328779 A1 * 12/2010 Llombart Juan ..... H01Q 19/06 359/619
2011/0215979 A1 * 9/2011 Lopez ..... H01Q 21/0043 343/770
2013/0321229 A1 * 12/2013 Klefenz ..... H01Q 21/0087 343/770
2014/0015725 A1 1/2014 Enders et al.
2014/0191895 A1 * 7/2014 Binzer ..... G01S 13/878 342/59
2014/0316865 A1 10/2014 Okamoto

FOREIGN PATENT DOCUMENTS

JP H01233901 A 9/1989
KR 101728328 B1 4/1917
WO WO 2013067740 A1 5/2013

OTHER PUBLICATIONS

Lockheed Martin, *Core System Requirements Specification* (*SyRS*), U.S. Department of Transportation, Research and Innovative Technology Administration, Apr. 2011 (131 Pages).
Search Report dated Jun. 26, 2018 for Great Britain Patent Application No. GB 1709999.5 (2 Pages).

* cited by examiner

MULTIPLE ORIENTATION ANTENNA FOR VEHICLE COMMUNICATION

TECHNICAL FIELD

The present disclosure generally relates to vehicle communication systems and more specifically, a multiple orientation antenna for vehicle communication.

BACKGROUND

In the United States, the Dedicated Short Range Communication (DSRC) network is being deployed as a part of the Intelligent Transportation System. DSRC facilitates vehicles communicating with other vehicles to coordinate driving maneuvers and provide warnings about potential road hazards. Additionally, DSRC facilitates communicating with infrastructure-based nodes, such as toll booths and traffic signals. The aim of deploying the DSRC protocol is to reduce fatalities, injuries, property destruction, time lost in traffic, fuel consumption, exhaust gas exposure, among others.

SUMMARY

The appended claims define this application. The present disclosure summarizes aspects of the embodiments and should not be used to limit the claims. Other implementations are contemplated in accordance with the techniques described herein, as will be apparent to one having ordinary skill in the art upon examination of the following drawings and detailed description, and these implementations are intended to be within the scope of this application.

Example embodiments are disclosed for a multiple orientation antenna for vehicle communications. An example multiple orientation antenna includes a housing and a first and second set of shutters embedded into the housing. The example multiple orientation antenna also includes a waveguide disposed within the housing defining a first and second set of slot antennas. The slot antennas of the first set of slot antennas are oriented to facilitate horizontal communication. The slot antennas of the second set of slot antennas are oriented to facilitate vertical communication. Additionally, the example multiple orientation antenna includes a rotation motor to rotate the housing.

An example vehicle communication system includes an antenna and an antenna controller. The antenna includes a plurality of shutters that, when open, facilitate communication through corresponding ones of a plurality of slot antennas. The example antenna controller, during a first time period, opens the plurality of shutters and continuously rotates the antenna. Additionally, the example antenna controller, during a second time period, selectively opens one or more of the plurality of shutters and orients the open shutters to directions specified by an orientation request.

BRIEF DESCRIPTION OF THE DRAWINGS

For a better understanding of the invention, reference may be made to embodiments shown in the following drawings. The components in the drawings are not necessarily to scale and related elements may be omitted, or in some instances proportions may have been exaggerated, so as to emphasize and clearly illustrate the novel features described herein. In addition, system components can be variously arranged, as known in the art. Further, in the drawings, like reference numerals designate corresponding parts throughout the several views.

DETAILED DESCRIPTION OF EXAMPLE EMBODIMENTS

Figure 1:
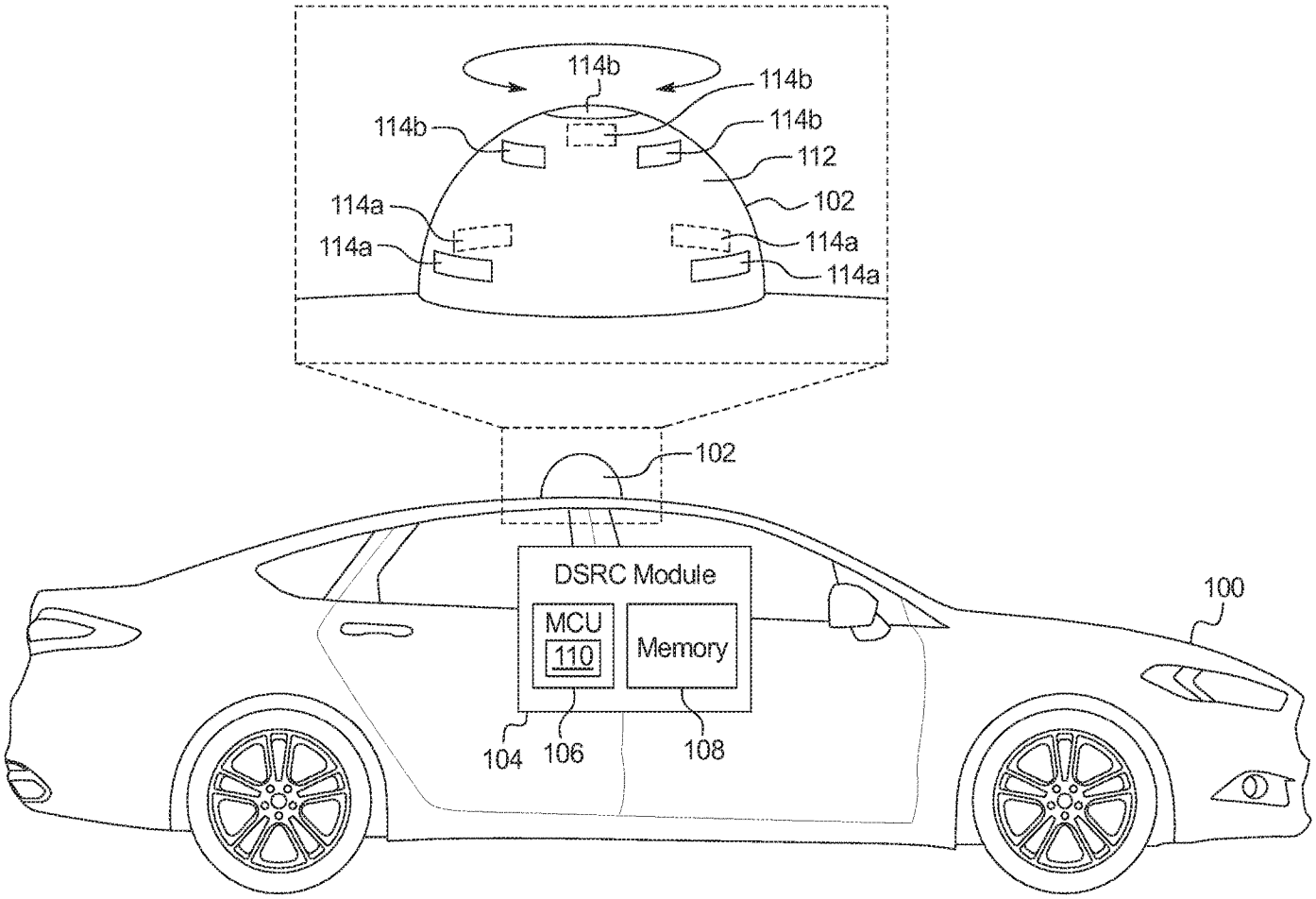
FIG. 1 illustrates a vehicle with a multiple orientation antenna in accordance with the teachings of this disclosure.

While the invention may be embodied in various forms, there are shown in the drawings, and will hereinafter be described, some exemplary and non-limiting embodiments, with the understanding that the present disclosure is to be considered an exemplification of the invention and is not intended to limit the invention to the specific embodiments illustrated.

The wireless communication technology facilitates connected vehicles exchanging information with other connected vehicles. This is sometimes referred to as vehicle-to-vehicle ("V2V") communication. Connected vehicles may also exchange information with wireless nodes coupled to infrastructure (e.g., traffic signals, lampposts, tunnels, bridges, etc.). This is sometimes referred to as vehicle-to-infrastructure ("V2I") communication. Connected vehicles may also exchange information with mobile devices (e.g., phones, smart watches, tablets, etc.) carried by pedestrians. This is sometimes referred to as vehicle-to-pedestrian ("V2P") communication. Together, V2V, V2I and V2P are jointly referred to as "V2X." The wireless communication technology includes any suitable technology that facilitates vehicles exchanging information. In some examples, ad hoc wireless local area networks are used to exchange information. Another example of wireless communication technology is direct short range communication ("DSRC"). DSRC is a wireless communication protocol or system, mainly meant for transportation, operating in a 5.9 GHz spectrum band. Connected vehicles using DSRC establish connections with each other and/or, from time to time, transmit safety messages that include the location of the vehicle, the speed and heading of the vehicle, and/or alerts affecting the performance of the vehicle. Traditionally, vehicles broadcast messages so that any other vehicle within range can receive the messages. Additionally, vehicles broadcast certain messages (e.g., safety messages, etc.) at regular intervals. As a result, especially in areas near buildings that reflect the radio frequency (RF) signals, the RF noise in an area may be substantial.

As disclosed below, a vehicle includes a multiple orientation antenna that directs RF signals toward the intended target vehicle(s) and/or infrastructure based nodes. The multiple orientation antenna includes apertures that act as slot antennas. Additionally, the slot antennas are covered by shutters that open and close. The multiple orientation antenna is rotatably mounted on the vehicle. In such a manner, a DSRC module, via the multiple orientation antenna, is able to control the orientation at which the DSRC module is to broadcast and receive messages. For example, when a group of vehicles are coordinating their movement via DSRC (sometime referred to as "a convoy"), for a first defined period of time, the multiple orientation antenna may be rotated and the particular shutters may be opened so that the RF signals are broadcast and received from the other vehicles (e.g., in front of and behind the vehicle), but not from other directions. In such an example, for a second defined period, the multiple orientation antenna may rotate to receive RF signals from other directions (e.g., to receive safety messages from vehicles not in the convoy, etc.). The DSRC module may rotate and configure the shutters based on instructions from electronic control units (ECUs) (e.g., an adaptive cruise control unit, etc.) and/or applications executing on an infotainment system (e.g., a navigation program, etc.).

FIG. 1 illustrates a vehicle 100 with a multiple orientation antenna 102 in accordance with the teachings of this disclosure. The vehicle 100 may be a conventional vehicle, a hybrid vehicle, an electric vehicle, or a fuel cell vehicle, etc. The vehicle 100 may be non-autonomous, semi-autonomous, or autonomous. The vehicle 100 includes parts related to mobility, such as a powertrain with an engine or an electric motor, a transmission, a suspension, a driveshaft, and/or wheels, etc. In the illustrated example, the vehicle 100 includes a DSRC module 104 and the multiple orientation antenna 102.

The DSRC module 104 includes radio(s) and software to broadcast messages and to establish direct connections between the vehicle 100, other vehicles, infrastructure-based modules (not shown), and mobile device-based modules (not shown). More information on the DSRC network and how the network may communicate with vehicle hardware and software is available in the U.S. Department of Transportation's Core June 2011 System Requirements Specification (SyRS) report (available at http://www its.dot.gov/meetings/pdf/CoreSystem_SE_SyRS_RevA%20(2011-06-13).pdf), which is hereby incorporated by reference in its entirety along with all of the documents referenced on pages 11 to 14 of the SyRS report. DSRC systems may be installed on vehicles and along roadsides on infrastructure. DSRC systems incorporating infrastructure information is known as a "roadside" system. DSRC may be combined with other technologies, such as Global Position System (GPS), Visual Light Communications (VLC), Cellular Communications, and short range radar, facilitating the vehicles communicating their position, speed, heading, relative position to other objects and to exchange information with other vehicles or external computer systems. DSRC systems can be integrated with other systems such as mobile phones.

Currently, the DSRC network is identified under the DSRC abbreviation or name. However, other names are sometimes used, usually related to a Connected Vehicle program or the like. Most of these systems are either pure DSRC or a variation of the IEEE 802.11 wireless standard. However, besides the pure DSRC system it is also meant to cover dedicated wireless communication systems between cars and roadside infrastructure system, which are integrated with GPS and are based on an IEEE 802.11 protocol for wireless local area networks (such as, 802.11p, etc.).

The DSRC module 104 includes a processor or controller 106 and memory 108. The processor or controller 106 may be any suitable processing device or set of processing devices such as, but not limited to: a microprocessor, a microcontroller-based platform, a suitable integrated circuit, one or more field programmable gate arrays ("FPGAs"), and/or one or more application-specific integrated circuits ("ASICs"). The memory 108 may be volatile memory (e.g., RAM, which can include non-volatile RAM, magnetic RAM, ferroelectric RAM, and any other suitable forms); non-volatile memory (e.g., disk memory, FLASH memory, EPROMs, EEPROMs, memristor-based non-volatile solid-state memory, etc.), unalterable memory (e.g., EPROMs), read-only memory, and/or high-capacity storage devices, such as hard drives, and/or a solid state drives. In some examples, the memory 108 includes multiple kinds of memory, particularly volatile memory and non-volatile memory.

The memory 108 is a computer readable medium on which one or more sets of instructions, such as the software for operating the methods of the present disclosure can be embedded. The instructions may embody one or more of the methods or logic as described herein. In a particular embodiment, the instructions may reside completely, or at least partially, within any one or more of the memory 108, the computer readable medium, and/or within the processor 106 during execution of the instructions.

The terms "non-transitory computer-readable medium" and "computer-readable medium" should be understood to include a single medium or multiple media, such as a centralized or distributed database, and/or associated caches and servers that store one or more sets of instructions. The terms "non-transitory computer-readable medium" and "computer-readable medium" also include any tangible medium that is capable of storing, encoding or carrying a set of instructions for execution by a processor or that cause a system to perform any one or more of the methods or operations disclosed herein. As used herein, the term "computer readable medium" is expressly defined to include any type of computer readable storage device and/or storage disk and to exclude propagating signals.

In the illustrated example, the DSRC module 104 includes an antenna controller 110. The antenna controller 110 controls the rotation of the multiple orientation antenna 102 and the shutters of the multiple orientation antenna 102. The antenna controller 110 is communicatively coupled to electronic control units (ECUs) in the vehicle 100 and to an infotainment system that executes applications (such as a navigation program, etc.) via a vehicle data bus (e.g., a controller area network (CAN) bus). In some examples, the antenna controller 110 controls the multiple orientation antenna 102 based on instructions received from the ECUs and/or applications executing on the infotainment system. For examples, an adaptive cruise control module may instruct the antenna controller 110 to configure the multiple orientation antenna 102 to communicated with other vehicles in a convoy during a particular timeslot. As another example, a navigation application executing on the infotainment system may instruct the antenna controller 110 to configure the multiple orientation antenna 102 to communicate with a tollbooth DSRC node that will be above the vehicle 100.

As discussed in more detail in FIG. 2 below, the multiple orientation antenna 102 includes a conductive housing 112 that defines apertures 114*a* and 114*b* that act as slot antennas. The aperture 114*a* and 114*b* are used to send and receive RF signals. When the antenna is sending, the RF signal is directed perpendicular to the orientation of the aperture 114*a* and 114*b*. When the antenna is receiving, the antenna gain pattern is in the direction perpendicular to the orientation of the aperture 114*a* and 114*b*. A first set of apertures 114*a* are defined along a circumference of the housing 112. The first set of apertures 114*a* polarize and guide the RF signals to facilitate communication is a horizontal direction. The first set of apertures 114*a* is controlled to communicate with, for example, other vehicles. A second set of apertures 114*b* are defined along a top portion and/or dome of the housing 112.

The second set of apertures 114*b* polarize and guide the RF signals to facilitate communication in a vertical direction. The second set of apertures 114*b* is controlled to communicate with, for example, infrastructure-based DSRC nodes above the vehicle 100. Transmission and reception gain is higher for the polarization RF signal that match the polarization of the apertures 114*a* and 114*b*. As a result, this increases the communications immunity to jamming. Under certain conditions, different polarization may be used. For example, when two vehicles 100 are communicating in an urban canyon, the direct transmission path between the vehicles is adequate and reflections from the vertical walls may create reception problems. In such an example, horizontally polarized RF signals are reflected poorly from vertical surfaces (e.g., the buildings forming the urban canyon), so the reflection interference is reduced. As another example, if a large vehicle (e.g., a semi-trailer truck) is between the two communicating vehicle 100 obscuring the direct path, then the vertically polarized RF signals may be used for communication. In such an example vertical polarization may improve the signal strength by improving the reflection from the vertical walls.

Figure 2:
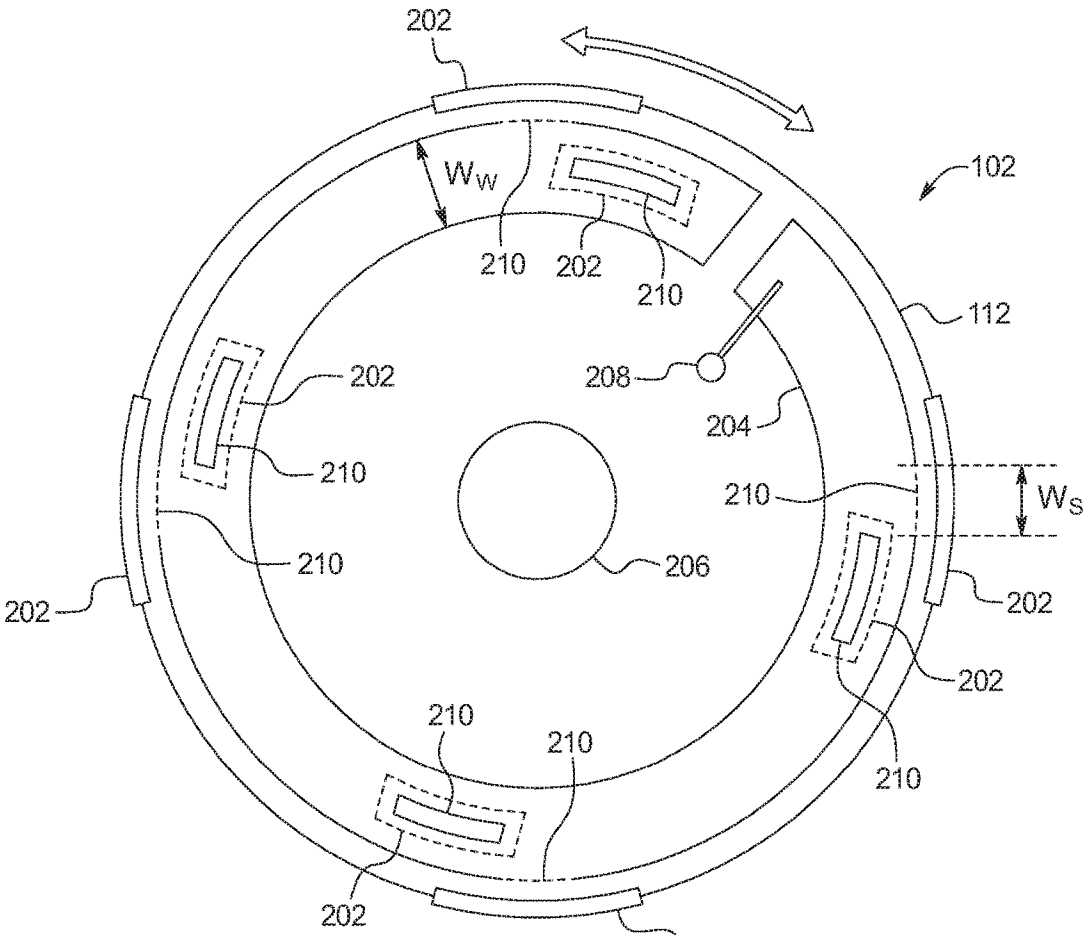
FIG. 2 is a top cutout view of the multiple orientation antenna of FIG. 1.

FIG. 2 is a top cutout view of the multiple orientation antenna 102 of FIG. 1. In the illustrated examples, the multiple orientation antenna 102 includes the housing 112, shutters 202, a waveguide 204, and a rotation motor 206. The housing 112 is composed conductive material (e.g., copper, aluminum, nickel, ferrous-based materials, etc.) that blocks RF signals. In the illustrated example, the housing 112 is dome-shaped with a circular cross section. Alternatively, in some examples, the housing 112 is cylinder-shaped. The housing 112 may be covered by a non-conductive material (e.g., nylon, polyethylene, etc.) to protect the multiple orientation antenna 102 from environmental factures (e.g., weather, dust, etc.). The non-conductive material physically blocks access to the shutters 202, but allow RF signals to pass through without attenuation.

The shutters 202 are embedded in a wall of the housing 112. The shutters 202 open to define aperture (e.g., the apertures 114*a* and 114*b* of FIG. 1.). The shutters 202 are composed of a conductive material to block RF signals when the shutters 202 are closed. The antenna controller 110 of FIG. 1 is communicatively coupled to the shutters 202 to facilitate the antenna controller 110 opening and closing the shutters 202. The antenna controller 110 controls the shutters independently. In such a manner, the antenna controller 110 controls the direction(s) to which the multiple orientation antenna 102 is broadcasting.

The waveguide 204 is a structure, such as a hollow conductive tube, that guides the RF signal from a signal input 208 to slots 210 in the waveguide 204. The wide dimension ($W_w$) (e.g., for waveguide 204 with a rectangular, oval, or square cross-section) or the diameter (e.g., for waveguide 204 with a circular cross-section) of the waveguide 204 is half the cutoff frequency of the signal radiated by the signal input 208. For examples, because DSRC operates in the 5.9 GHz spectrum band, the wide dimension of the waveguide 204 may be 4.04 centimeters (1.59 inches) (e.g., an F Band waveguide (WR-159) as defined by the Electronic Industries Alliance (EIA)). The signal input 208 of the waveguide is communicatively coupled to the DSRC module 104. To broadcast a message, the DSRC module 104 radiates the RF signal via the signal input 208. To receive a message, the DSRC module 104 processes signals detected by the signal input 208. The slots 210 of the waveguide 204 are aligned with the shutters 202. When the corresponding shutter 202 is open, the RF signal radiated from the signal input 208 is radiates out the slots 210. When the corresponding shutter 202 is closed, the shutter 202 blocks the RF signal radiated from the signal input 208. The slots 210 of the waveguide 204 have a width ($W_s$) equal to half the wavelength ($\lambda/2$) of the RF signal radiated by the signal input 208. For example, because DSRC operates in the 5.9 GHz spectrum band, the width of the slots 210 may be 2.54 centimeters (1 inch). The waveguide 204 is fixed to the housing 112 so that the waveguide 204 and the housing 112 rotate together.

The rotation motor 206 rotates the multiple orientation antenna 102. The rotation motor 206 is communicatively coupled to the antenna controller 110. Additionally, the rotation motor 206 facilitates the antenna controller 110 to control the directions at which the shutters 202 are facing. In such a manner, coupled with the shutters 202, the antenna controller 110 controls the orientation at which the multiple orientation antenna 102 broadcasts messages. The DSRC module 104 is coupled to a global positioning system (GPS) receiver and, in some examples, an inertial navigation system (INS) that provides a position, a bearing, and a time for the vehicle 100. The antenna controller 110 uses the timing, location, and bearing to synchronize the antenna position with the other vehicles.

Figure 3A:
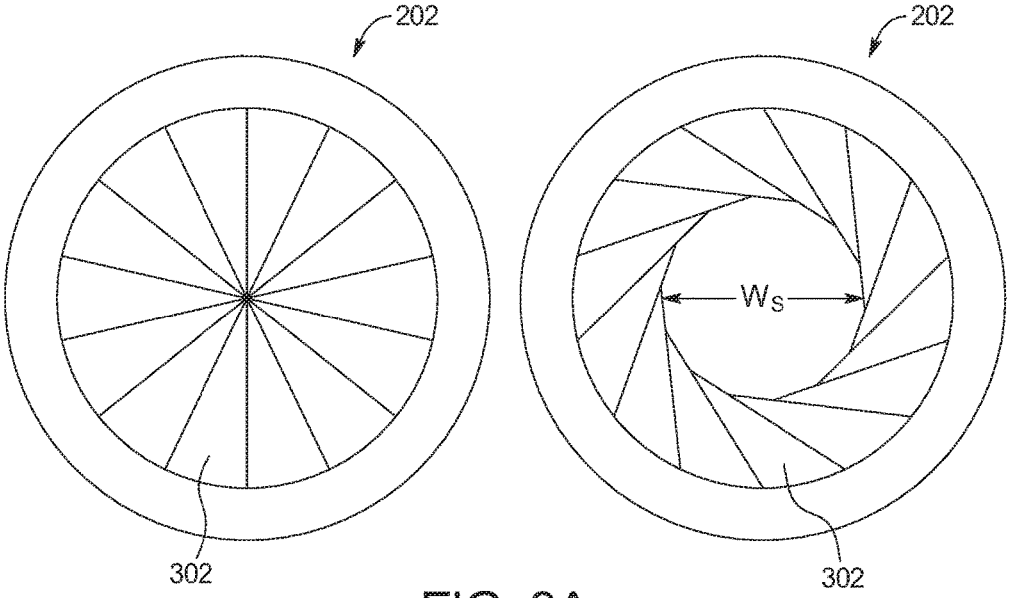
FIGS. 3A and 3B illustrate adjustable shutters of the multiple orientation antenna of FIGS. 1 and 2.
Figure 3B:
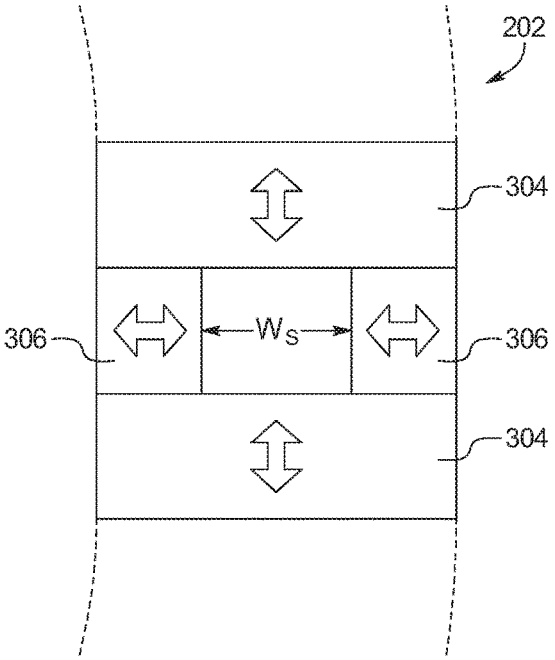

FIGS. 3A and 3B illustrate adjustable shutters 202 of the multiple orientation antenna 102 of FIGS. 1 and 2. FIG. 3A illustrates a shutter 202 with an iris diaphragm 302. When instructed by the antenna controller 110, the iris diaphragm 302 opens to define an opening that exposes the corresponding slot 210 on the waveguide 204. The iris diaphragm 302 opens to have the width ($W_s$) of the corresponding slot 210. FIG. 3B illustrates a shutter 202 with vertical doors 304 and horizontal doors 306. When instructed by the antenna controller 110, the doors 304 and 306 open to expose the corresponding slot 210. The doors 304 and 306 open to have the width ($W_s$) of the corresponding slot 210.

Figure 4A:
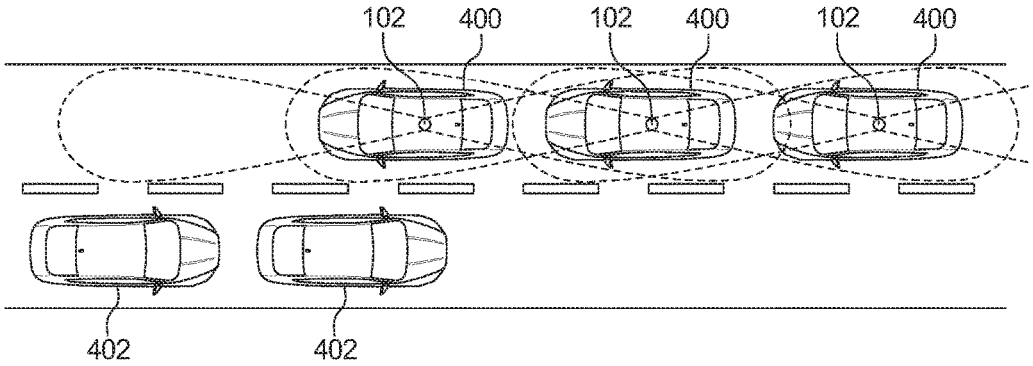
FIGS. 4A and 4B illustrate vehicles with the multiple orientation antenna FIGS. 1 and 2.
Figure 4B:
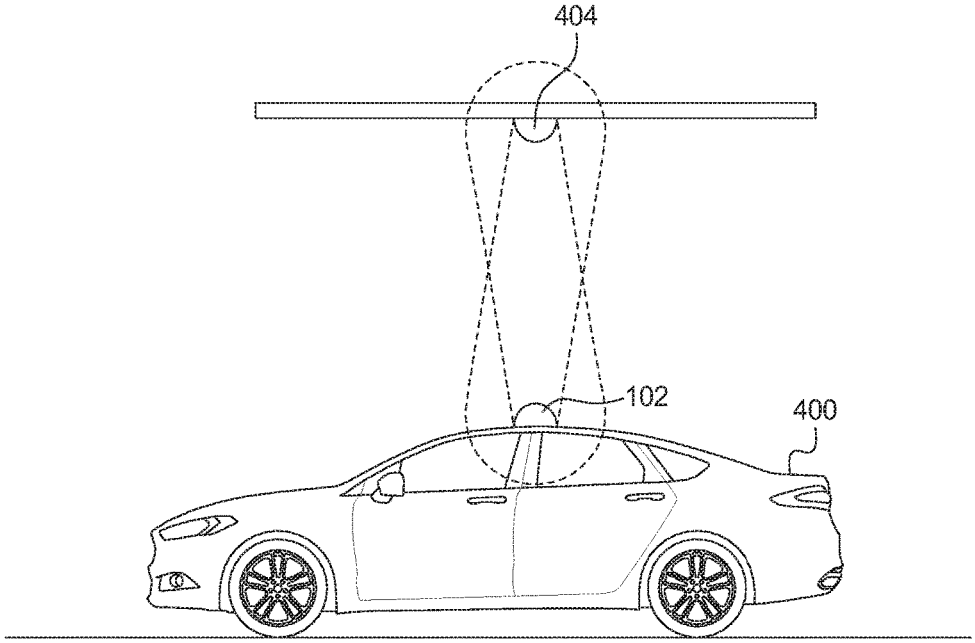

FIGS. 4A, 4B, and 4C illustrate vehicles 400 with the multiple orientation antenna 102 FIGS. 1 and 2. FIG. 4A illustrates the vehicles 400 in a convoy. The antenna controllers 110 rotates of the vehicles 400, via the rotation motors 206, orient the multiple orientation antennas 102 so that one of the shutters 202 is facing in front of the corresponding vehicle 400 and one of the shutters is facing behind the corresponding vehicle 400. Additionally, the antenna controllers 110 open the corresponding shutters 202. In some examples, the instructions to align the multiple orientation antenna 102 are received from an ECU, such as the adaptive cruise control. In such a manner, the vehicles 400 exchange messages to coordinate movement without causing signal noise to other vehicles 402 not in the convoy. FIG. 4B illustrates the vehicle 400 communicating with an infrastructure-based node 404 that is above the vehicle 400. The antenna controller 110 opens the shutters 202 on the top of the housing 112 to facilitate the multiple orientation antenna 102 exchanging messages with the infrastructure-based node 404. For example, the infrastructure-based node 404 may be coupled to a tollbooth. In some examples, the antenna controller 110 is instructed to open the shutter(s) 202 on top of the housing 112 by an application executing on the infotainment system. For example, a navigation program may, in response to detecting a tollbooth ahead on the current route of the vehicle 400, instruct the antenna controller 110.

Figure 5:
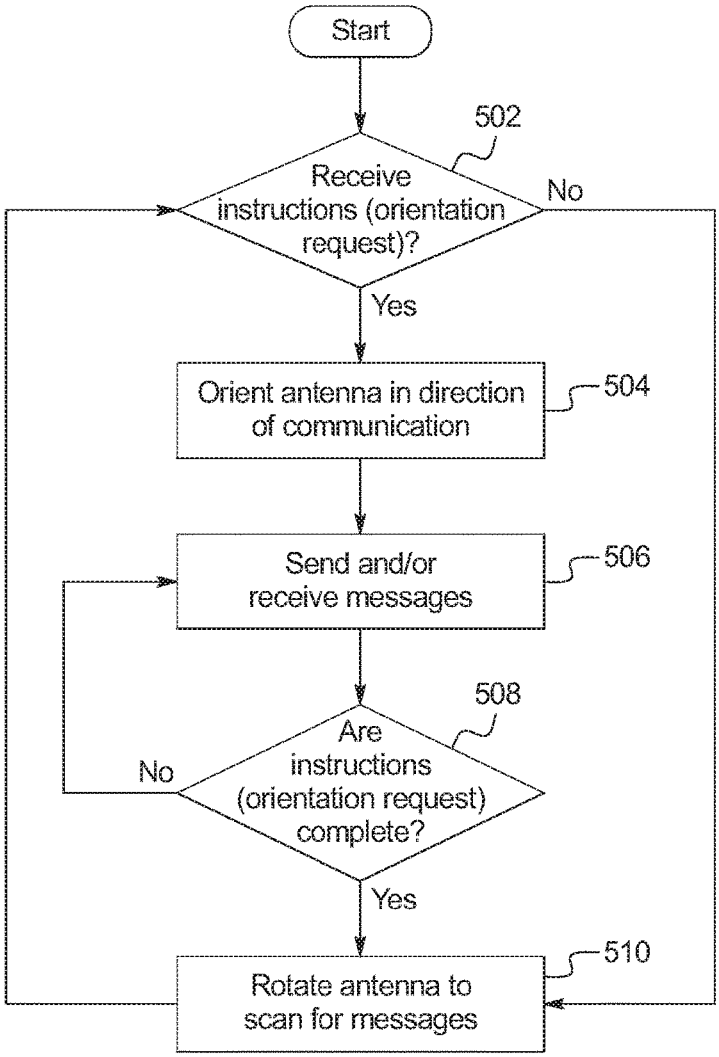
FIG. 5 is a flowchart of an example method to control the multiple orientation antenna of FIGS. 1 and 2.

FIG. 5 is a flowchart of an example method to control the multiple orientation antenna 102 of FIGS. 1 and 2. Initially, at block 502, the antenna controller 110 determines whether an instruction (sometimes referred to as "an orientation request") has been received. A trigger may be received from an ECU and/or an application executing on the infotainment system. For example, an adaptive cruise control unit may, when the vehicle 100 is traveling in a convoy, send an instruction to the antenna controller 110 during a designated time period in which the vehicles in the convoy are to coordinate movement. If the instruction has been received, the method continues to block 504. Otherwise if the instruction has not been received, the method continues to block 510.

At block 504, the antenna controller 110 orients the apertures 114*a* and 114*b* of the multiple orientation antenna 102 in accordance with the instruction received at block 502. In some examples, the antenna controller 110 open the shutters 202 corresponding to the direction(s) that the multiple orientation antenna 102 is communicate. At block 506, the DSRC module 104 sends and/or receives messages via the multiple orientation antenna 102. At block 508, the antenna controller 110 determines whether the instruction received at block 502 is complete. For example, a time period specified by the instruction may have elapsed or the vehicle may no longer in the vicinity of the infrastructure-based DSRC node specified by the instruction. If the instruction is complete, the method continues to block 510. If the instruction is not complete, the method returns to block 506. At block 510, the antenna controller 110 rotates multiple orientation antenna 102 to scan for messages (e.g. safety message broadcast by other vehicles) and/or broadcast messages (e.g., a safety message, etc.).

The flowchart of FIG. 5 is a method that may be implemented by machine readable instructions that comprise one or more programs that, when executed by a processor (such as the processor 310 of FIG. 3), cause the DSRC module 104 to implement the antenna controller 110 of FIG. 1. Further, although the example program(s) is/are described with reference to the flowcharts illustrated in FIG. 5, many other methods of implementing the example antenna controller 110 may alternatively be used. For example, the order of execution of the blocks may be changed, and/or some of the blocks described may be changed, eliminated, or combined.

In this application, the use of the disjunctive is intended to include the conjunctive. The use of definite or indefinite articles is not intended to indicate cardinality. In particular, a reference to "the" object or "a" and "an" object is intended to denote also one of a possible plurality of such objects. Further, the conjunction "or" may be used to convey features that are simultaneously present instead of mutually exclusive alternatives. In other words, the conjunction "or" should be understood to include "and/or". The terms "includes," "including," and "include" are inclusive and have the same scope as "comprises," "comprising," and "comprise" respectively.

The above-described embodiments, and particularly any "preferred" embodiments, are possible examples of implementations and merely set forth for a clear understanding of the principles of the invention. Many variations and modifications may be made to the above-described embodiment(s) without substantially departing from the spirit and principles of the techniques described herein. All modifications are intended to be included herein within the scope of this disclosure and protected by the following claims.

What is claimed is:

1. A multiple orientation antenna comprising:

a housing having a dome-shape;

a waveguide disposed within the housing and defining: a first set of slot antennas oriented to face a first circumference of the housing and propagate first signals in horizontal directions; and a second set of slot antennas oriented to face a second smaller circumference of the housing and propagate second signals in vertical directions; and a rotation motor to rotate the housing, wherein the housing includes a base, wherein the base is attached to the rotation motor, and wherein the first set of slot antennas are positioned on the housing such that the first set of slot antennas are closer to the base than the second set of slot antennas.

2. The multiple orientation antenna of claim 1, further comprising a first and second set of shutters embedded in to the housing, wherein the first set of shutters are aligned with the first set of slot antennas, and the second set of shutters are aligned with the second set of slot antennas.

3. The multiple orientation antenna of claim 1, wherein the first and second sets of shutters include a conductive material to block radio frequency signals when the shutters are closed.

4. The multiple orientation antenna of claim 1, wherein the housing includes a conductive material to block radio frequency signals.

5. The multiple orientation antenna of claim 1, wherein the shutters of the first and the second set of shutters open and close in response to signals received from an antenna controller.

6. The multiple orientation antenna of claim 5, wherein each of the shutters of the first and the second set of shutters open and close are controlled by the antenna controller independently.

7. The multiple orientation antenna of claim 1, wherein the rotation motor rotates the housing in response to signals received from an antenna controller.

8. The multiple orientation antenna of claim 1, wherein the shutters of the first and the second set of shutters include an iris diaphragm that opens in response to a signal received from an antenna controller.

9. The multiple orientation antenna of claim 1, wherein the shutters of the first and the second set of shutters include a first and second set of doors that open to in response to a signal received from an antenna controller.

10. The multiple orientation antenna of claim 1, wherein the waveguide and the housing are fixed to teach other, and wherein the rotation of the housing causes the waveguide to rotate.

11. The multiple orientation antenna of claim 1, wherein a cross-section of the waveguide is oval.

12. A multiple orientation antenna comprising:

a housing having a dome-shape;

a waveguide disposed within the housing and defining: a first set of slot antennas oriented to face a first circumference of the housing and propagate first signals in horizontal directions; and a second set of slot antennas oriented to face a second smaller circumference of the housing and propagate second signals in vertical directions; and a rotation motor to rotate the housing, wherein a first width of the waveguide is greater than a second width of each of the first set of slot antennas and the second set of slot antennas, and wherein the housing includes a circular base, wherein the wave guide extends in a circular direction, wherein a direction of the first width is parallel with a direction of a radius of the circular base, and wherein a direction of the second width is parallel with the circular direction.

* * * * *